US005708385A

United States Patent [19]

Shou et al.

[11] Patent Number: 5,708,385

[45] Date of Patent: Jan. 13, 1998

[54] WEIGHTED ADDITION CIRCUIT

[75] Inventors: Guoliang Shou; Sunao Taktori; Makoto Yamamoto, all of Tokyo, Japan

[73] Assignees: Yozan, Inc., Tokyo; Sharp Kabushiki Kaisha, Osaka, both of Japan

[21] Appl. No.: 657,757

[22] Filed: May 31, 1996

[30] Foreign Application Priority Data

Jun. 2, 1995 [JP] Japan ..... 7-159907

[51] Int. Cl.[6] ..... G06G 7/42

[52] U.S. Cl. ..... 327/361; 327/334; 327/355

[58] Field of Search ..... 327/334, 355, 327/361

[56] References Cited

U.S. PATENT DOCUMENTS

| | | | |
|---|---|---|---|
| 3,757,234 | 9/1973 | Ohlson | 328/142 |
| 3,970,774 | 7/1976 | Bazin et al. | 327/361 |
| 5,394,107 | 2/1995 | Shou et al. | 327/354 |
| 5,453,711 | 9/1995 | Yamamoto | 327/355 |
| 5,457,417 | 10/1995 | Shou et al. | 327/356 |
| 5,465,064 | 11/1995 | Shou et al. | 327/361 |
| 5,469,102 | 11/1995 | Shou et al. | 327/361 |
| 5,490,099 | 2/1996 | Shou et al. | 364/606 |
| 5,500,618 | 3/1996 | Comer | 327/361 |
| 5,532,580 | 7/1996 | Shu et al. | 323/354 |
| 5,568,080 | 10/1996 | Shou et al. | 327/356 |

OTHER PUBLICATIONS

Mims III "Engineer's Mini-Notebook Op Amp Circuits" Siliconcepts 1985 U.S.A., p. 18.

"The Bases of MOS Integration Circuit", Figure 5-26 in page 154 and Figure 5-28 in page 155, HARA, Kindai Kagaku-sha, 1992 (Title translated by applicant).

*Primary Examiner*—Timothy P. Callahan
*Assistant Examiner*—Jeffrey Zweizig
*Attorney, Agent, or Firm*—Cushman, Darby & Cushman IP Group of Pillsbury Madison & Sutro LLP

[57] ABSTRACT

A weighted addition circuit contains a plurality of resistances, each of which is connected to a common output at one terminal and to different input voltages at the other terminal. The voltage at the common output terminal is a balance voltage of the input resistances. The common output terminal is connected to an amplifier having an odd number of stages of inverters and a feedback resistance connecting the output of the last inverter stage to the input of the first inverter stage. Grounded low pass capacitors and/or balance resistors are also be included in the amplifier to improve the stability of the circuit and prevent undesirable oscillation. Providing a circuit containing a balance voltage of the parallel-connected input resistances allows for precise weighted addition of any number of inputs while still maintaining a small and simple circuit structure.

3 Claims, 2 Drawing Sheets

WEIGHTED ADDITION CIRCUIT

FIELD OF THE INVENTION

The present invention is related to a weighted addition circuit for outputting a plurality of analog or multi-valued input voltages after performing addition and amplification.

BACKGROUND OF THE INVENTION

Conventionally, in a weighted addition circuit, digital type and analog type addition circuits are used.

However, there are problems that the size of the digital type weighted addition circuit becomes large and the analog type weighted addition circuit is inaccurate in calculation.

SUMMARY OF THE INVENTION

An object of the present invention is to solve the above conventional problems and to provide an addition circuit having accurate operation and a small size.

In order to accomplish the above object, an addition circuit according to the present invention includes a plurality of input resistances, each of which has an input voltage at one terminal and a connection to a common output at the other terminal, and an amplifying circuit connected to the common output of the input resistances. The amplifying circuit has serial inverters with an odd number of stages and a feedback resistance for feeding back an output of the inverter of the last stage to an input of the inverter of the first stage.

PREFERRED EMBODIMENT OF THE PRESENT INVENTION

Figure 1:
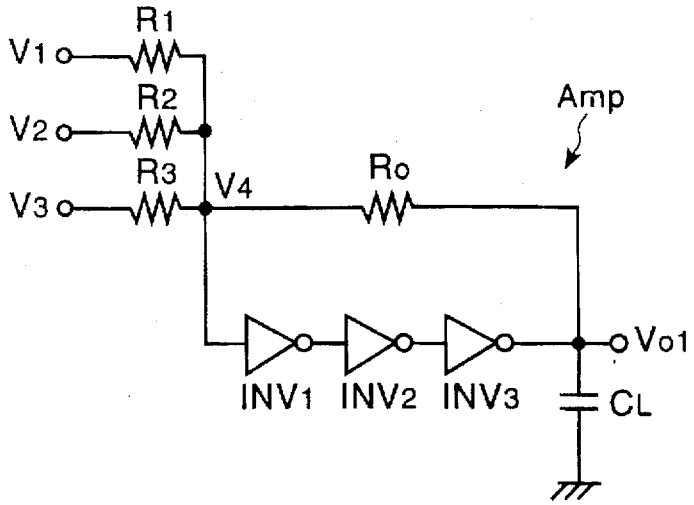
FIG. 1 shows an circuit of the first embodiment of the weighted addition circuit according to the present invention

Hereinafter, embodiments of the weighted addition circuit according to the present invention are described. FIG. 1 shows a circuit diagram of weighted addition circuit of this invention.

The weighted addition circuit of the embodiment includes a plurality of input resistances R1, R2 and R3, each having input and output terminals. In this embodiment, there are three input resistances. Input voltages V1, V2 and V3 are input to the input resistances at the input terminals, respectively. The output terminals are all connected to the input terminal of the amplifying circuit Amp.

The amplifying circuit Amp contains an odd number of serially connected inverters INV1, INV2 and INV3 and a feedback resistance Ro for feeding back an output of the last stage inverter INV3 to the input of the first stage inverter INV1. A low-pass capacitance CL is connected at one terminal to the output of the inverter of the last stage and is grounded at the other terminal to prevent unstable oscillation.

Assuming the impedance of amplifying circuit Amp to be infinite, formulas (1) to (5) are true. Here, V4 is a balancing voltage at the common output of the resistances connected together, Vo1 is an output voltage of Amp, and I1, I2, I3 and I4 are electric currents through the resistances R1, R2, R3 and Ro, respectively.

$$I1 = \frac{V1 - V4}{R1} \tag{1}$$

$$I2 = \frac{V2 - V4}{R2} \tag{2}$$

$$I3 = \frac{V3 - V4}{R3} \tag{3}$$

$$I4 = \frac{V4 - VO1}{Ro} \tag{4}$$

$$I1 + I2 + 13 = I4 \tag{5}$$

Actually, when the impedance of Amp is sufficiently high, the above formulas from (1) to (5) are approximately valid. In this case, output voltage Vo1 is as below.

$$Vo1 = -\frac{\frac{V1}{R1} + \frac{V2}{R2} + \frac{V3}{R3}}{\frac{1}{Ro}} + V4\frac{\frac{1}{R1} + \frac{1}{R2} + \frac{1}{R3}}{\frac{1}{Ro}} \tag{6}$$

The result of the weighted addition is amplified and output by the amplifying circuit, as well as any amplification gain that can be obtained according to the resistance value of feedback resistance Ro.

Though the number of input voltages is three in the first embodiment, any number equal to or more than two can be set so that the weighted addition of input voltages is performed by connecting resistances of a number of input voltages to a common output. Generalizing formula (6) with adding an offset term, formula (7) can be obtained. Here, V4 is a constant and usually, V4=Vdd/2.

$$Vol = -\Sigma\frac{V1}{R1} \cdot R0 + \left(\Sigma\frac{Ro}{Ri} + 1\right) \cdot V4 \tag{7}$$

Figure 2:
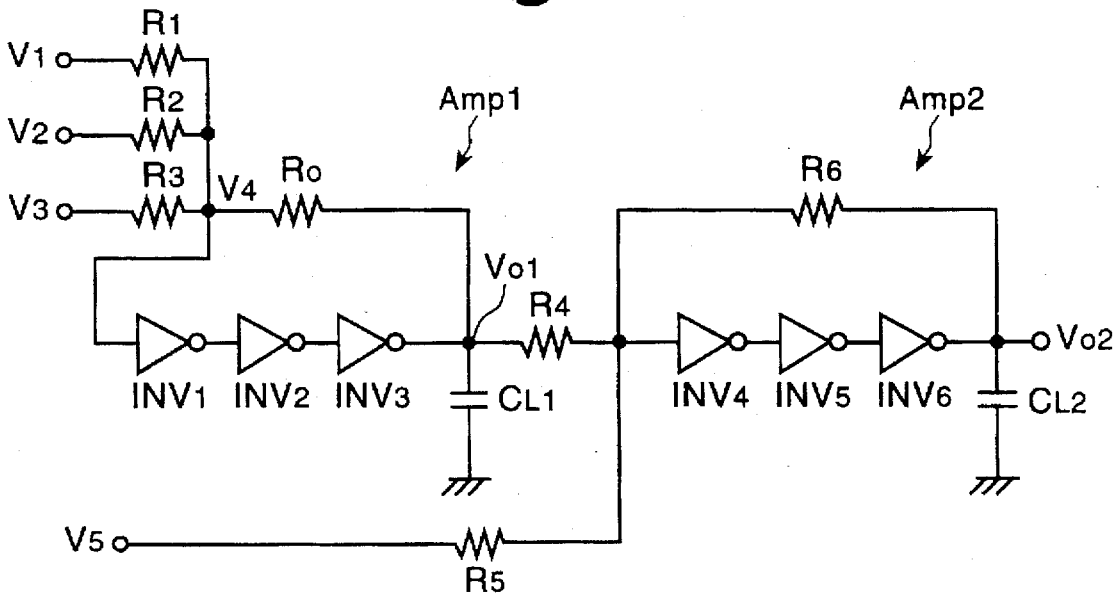
FIG. 2 shows an circuit of the second embodiment of the weighted addition circuit according to the present invention.

FIG. 2 shows a circuit of the second embodiment of the weighted addition circuit of the present invention. Similarly to FIG. 1, an addition circuit in FIG. 2 includes input resistances R1, R2 and R3, each of which receives terminal input voltages V1, V2 and V3, respectively, at one terminal and connects at the other terminal to the common output. The first amplifying circuit Amp1 is connected to the common output of the input resistances.

The second amplifying circuit Amp2 is connected at its input through an intermediate resistance R4 to an output of Amp1. An intermediate resistance R5 is connected to Amp2 at one terminal and to an input voltage. V5 at the other terminal. V5 is subtracted from the output of Amp1.

The first amplifying circuit Amp1 consists of three stages of inverters INV1, INV2 and INV3, serially connected, and feedback resistance Ro for, feeding back an output of the last stage inverter INV3 to an input of the first stage inverter INV1.

In the same way, the second amplifying circuit Amp2 consists of three stages of inverters INV4, INV5 and INV6, serially connected, and a feedback resistance R6.

At the output terminal of the last stage inverter of the amplifying circuits Amp1 and Amp2, grounded low-pass capacitances CL1 and CL2 are connected, respectively, for preventing unstable oscillation.

Output voltage Vo2 of the second amplifying circuit Amp2 is expressed as in formula (8).

$$Vo2 = -\frac{\frac{Vo1}{R4} + \frac{V5}{R5}}{\frac{1}{R6}} + Voff\frac{\frac{1}{R4} + \frac{1}{R5}}{\frac{1}{R6}} + Voff \quad (8)$$

Here, assuming the input voltages of Amp1 and Amp2 to be Voff, R6=R4 and R6/R5=Ro(1/R1+1/R2+1/R3), and replacing Vo1 in formula (8) with formula (6), then, formula (9) can be obtained.

$$Vo2 = \frac{\frac{V1}{R1} + \frac{V2}{R2} + \frac{V3}{R3}}{\frac{1}{Ro}} - \frac{\frac{1}{R1} + \frac{1}{R2} + \frac{1}{R3}}{\frac{1}{Ro}} V5 + Voff \quad (9)$$

Further, changing the condition of R6/R5 in formula (8) as in formula (10), Voff is canceled and formula (9) is simplified as in formula (11).

$$\frac{R6}{R5} + 1 = Ro\left(\frac{1}{R1} + \frac{1}{R2} + \frac{1}{R3}\right) \quad (10)$$

$$Vo2 = \frac{\frac{V1}{R1} + \frac{V2}{R2} + \frac{V3}{R3}}{\frac{1}{Ro}} - \left(\frac{\frac{1}{R1} + \frac{1}{R2} + \frac{1}{R3}}{\frac{1}{Ro}} - 1\right) V5 \quad (11)$$

Offset voltage in LSI is precisely controlled and the operation according to formula (9) is practical enough. As mentioned, Voff is usually settled as Vdd/2.

From formulas (9) and (10), it is clear that the value of output voltage Vo2 is a subtraction result of a subtrahend having a value of voltage V5 and a minuend having a value equal to the sum of input voltages V1, V2 and V3.

Figure 3:
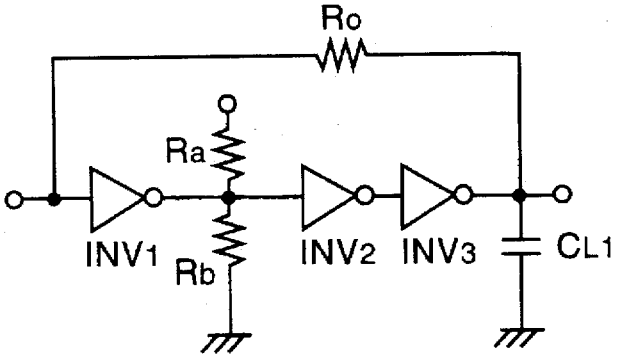
FIG. 3 shows a variation of an amplifying circuit used in the first and the second embodiments.
Figure 4:
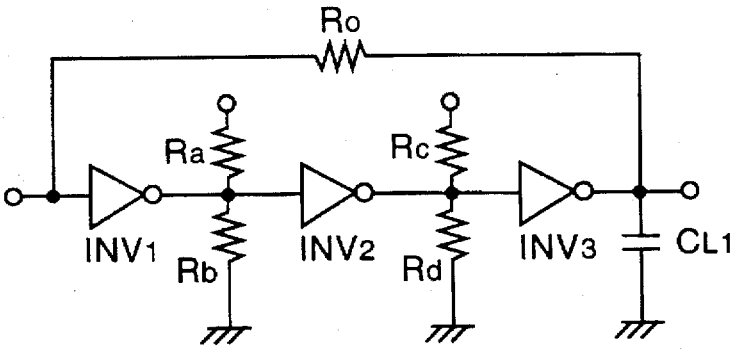
FIG. 4 shows another variation of an amplifying circuit used in the first and the second embodiments.
Figure 5:
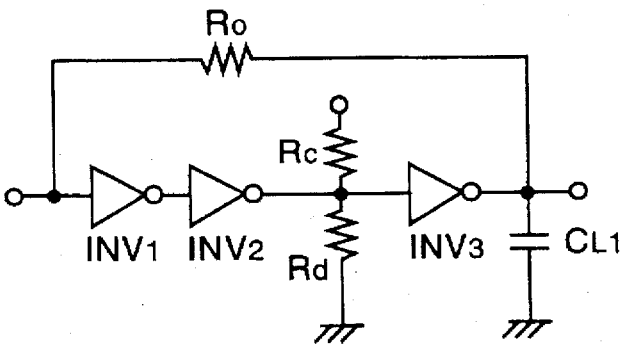
FIG. 5 shows yet another variation of an amplifying circuit used in the first and the second embodiments.

FIG. 3, 4 and 5 are variations of the amplification circuit in the circuit of FIG. 1 and the first and the second amplification circuits Amp1 and Amp2 in FIG. 2. In the circuit of FIG. 3, balance resistances Ra and Rb are provided between inverter INV1 of the first stage and inverter INV2 of the second stage. In FIG. 4, balance resistances Rc and Rd are provided between inverter INV2 of the second stage and inverter INV3 of the third stage, in addition to resistances Ra and Rb shown in FIG. 3. In FIG. 5, only resistances Rc and Rd are provided between inverter INV2 of the second stage and inverter INV3 of the third stage.

Though theoretically, unstable oscillation is prevented by either the low-pass capacitance CL1 or the balance resistance alone, there is a problem that the capacity becomes too large when capacitance CL1 is solely provided, and the linearity becomes poor when balance resistances R11 and R12 are solely provided. Therefore, in FIGS. 3, 4 and 5, both a low pass capacitance and balance resistances are provided.

As mentioned above, it is possible to perform precise weighted addition in an analog circuit of small size because of the structure for outputting the balance voltage of input resistances connected together, and it is also possible to handle any number of input by simple structure according to the present invention.

What is claimed is:

1. A weighted addition circuit comprising:

a plurality of input resistances each having an input terminal and an output terminal, each of said input terminals receiving an input voltage and each of said output terminals being connected to a common output, wherein a sum of said input voltages is a minuend;

a first amplifying circuit connected to said common output of said input resistances, said first amplifying circuit comprising three stages of serially connected inverters and a feedback resistance for feeding back an output of an inverter from a last stage to an input of an inverter from a first stage;

a first intermediate resistance having input and output terminals, said input terminal of said first intermediate resistance connected to an output of said first amplifying circuit;

a second intermediate resistance having input and output terminals, said input terminal of said second intermediate resistance receiving an input voltage as a subtrahend;

a second amplifying circuit connected to said output terminals of said first and second intermediate resistances, said second amplifying circuit containing three stages of serially connected inverters and a feedback resistance for feeding back an output of an inverter from a last stage to an input of an inverter from a first stage; and a capacitance connected between the output of a last stage of said inverters in at least one of said first and second amplifying circuits and ground to increase circuit stability.

2. A weighted addition circuit as claimed in claim 1, wherein a first ratio between a first composite resistance derived from said plurality of said input resistances and said feedback resistance in said first amplifying circuit is smaller by at least 1 than a second ratio between said second intermediate resistance and said feedback resistance in said second amplifying circuit.

3. A weighted addition circuit as claimed in claim 1, further comprising at least one balance resistance having one terminal connected between two inverters in said first or second amplifying circuit and the other terminal connected to a power supply or to the ground.

* * * * *